US010632598B2

(12) United States Patent
Wu

(10) Patent No.: US 10,632,598 B2
(45) Date of Patent: Apr. 28, 2020

(54) JOINT-REMOVING TOOL

(71) Applicant: Pi-Liang Wu, Taichung (TW)

(72) Inventor: Pi-Liang Wu, Taichung (TW)

( * ) Notice: Subject to any disclaimer, the term of this patent is extended or adjusted under 35 U.S.C. 154(b) by 306 days.

(21) Appl. No.: 15/499,907

(22) Filed: Apr. 28, 2017

(65) Prior Publication Data

US 2018/0236643 A1 Aug. 23, 2018

(30) Foreign Application Priority Data

Feb. 23, 2017 (TW) ..... 106106287 A

(51) Int. Cl.

| | |
|---|---|
| ***B25B 7/12*** | (2006.01) |
| ***B25B 27/02*** | (2006.01) |
| ***B25B 9/00*** | (2006.01) |
| ***B25B 27/00*** | (2006.01) |
| *B25B 25/00* | (2006.01) |

(52) U.S. Cl.

CPC ..... *B25B 27/02* (2013.01); *B25B 7/12* (2013.01); *B25B 9/00* (2013.01); *B25B 27/0035* (2013.01); *B25B 25/005* (2013.01)

(58) Field of Classification Search

USPC ..... 81/3.8, 345, 112, 129.5, 351, 309; 294/116

See application file for complete search history.

(56) References Cited

U.S. PATENT DOCUMENTS 1,242,097 A * 10/1917 Anderson ..... B25B 13/44 81/128
1,419,222 A * 6/1922 Chadderton ..... B25B 13/44 81/128
1,509,067 A * 9/1924 Drummond ..... B25B 13/12 81/61
1,927,528 A * 9/1933 Nilsson ..... H01H 85/0208 81/3.8
5,267,766 A * 12/1993 Geissler ..... B23Q 3/1554 294/115
6,276,236 B1 * 8/2001 Wu ..... B25B 7/12 81/347
6,983,677 B1 1/2006 Engel
7,104,162 B1 * 9/2006 Wu ..... B25B 7/12 81/3.07
2013/0319165 A1 * 12/2013 Gillet ..... F16C 1/12 74/501.6
2018/0290276 A1 * 10/2018 Wu ..... B25B 25/005

FOREIGN PATENT DOCUMENTS

TW M449065 3/2013
TW I564120 1/2017

* cited by examiner

*Primary Examiner* — Monica S Carter
*Assistant Examiner* — Mahdi H Nejad

(57) ABSTRACT

A joint-removing tool includes a control unit, a clamp unit and a connector unit. The control unit includes two pivotally connected levers each including a handle and a pivoting section. The handle and the pivoting section of the first lever are located between that of the second lever. The clamp unit includes a shell and two jaws. Each of the jaws includes a first section movably inserted in the shell, a second section in contact with the shell, and a third section located out of the shell. The connector unit includes a wire extending throughout a sheath. The wire includes an end connected to the pivoting section of the first lever and another end connected to the first sections of the jaws. The sheath includes an end connected to the pivoting section of the second lever and another end connected to the shell.

11 Claims, 9 Drawing Sheets

JOINT-REMOVING TOOL

BACKGROUND OF INVENTION

1. Field of Invention

The present invention relates to a tool for repairing a vehicle and, more particularly, to a tool for removing a joint from tubes of a vehicle.

2. Related Prior Art

A vehicle includes tubes made of rubber or any other flexible material to transfer lubricant oil, fuel and water. A joint is used to connect a tube to another tube.

Referring to FIGS. 1 and 2, two tubes 91 and 92 are joined by a joint 1. The joint 1 includes an anchoring element 11, a C-clip 12 and a socket 13. The anchoring element 11 includes two locking strips 112 located opposite to each other relative to the axis of the first tube 91. The socket 13 includes a ferrule 131 formed at an end and two openings 132 made near another end. The openings 132 are located opposite to each other relative to the axis of the socket 13. In use, the second tube 92 is fitted in the ferrule 131. The anchoring element 11 is located on and round the first tube 91, and the C-clip 12 is inserted in an annular groove made in the periphery of the first tube 91. Thus, the anchoring element 11 is kept on the and round the first tube 91. The anchoring element 11 is inserted in the socket 13, and the locking strips 112 are inserted in the openings 132 so that the anchoring element 11 and the socket 13 are joined, and the first and second tubes 91 and 92 are joined by the joint 1.

To disconnect the first tube 91 from the second tube 92, the locking strips 112 are pivoted toward each other and removed from the openings 132. Then, the anchoring element 11 is removed from the socket 13. That is, the first tube 91 is disconnected from the second tube 92.

Referring to FIGS. 3 and 4, the tubes 91 and 92 are joined by another joint 2. The joint 2 includes a plug 24, a socket 25 and a lock 26. The plug 24 includes an annular rib 244 formed near a first end. The socket 25 includes an annular ring 251 near a first end and two openings 252 near a second end. The openings 252 are located opposite to each other relative to an axis of the socket 25. The lock 26 is formed on the socket 25. The lock 26 includes two locking strips 261. Each of the locking strips 261 is located in a corresponding one of the openings 252. In use, the first end of the plug 25 is fitted in the second tube 92, and a second end of the plug 24 is fitted in the first tube 91. The first end of the plug 24 is inserted in the second end of the socket 25. The annular rib 244 is engaged with the locking strips 261. Thus, the plug 24 and the socket 25 are joined. The first tube 91 and the second tube 92 are joined by the joint 2.

To disconnect the first tube 91 from the second tube 92, the locking strips 261 are pivoted and disengaged from the annular fib 244. Then, the plug 24 is removed from the socket 25, and the first tube 91 is disconnected from the socket 25.

To pivot the locking strips 112 or the locking strips 261 to allow the disconnection of the first tube 91 from the second tube 92, a pair of sharp-nose pliers can be used. However, it is difficult to maneuver such pair of sharp-nose pliers in an engine compartment which is small.

The present invention is therefore intended to obviate or at least alleviate the problems encountered in prior art.

SUMMARY OF INVENTION

It is the primary objective of the present invention to provide a convenient joint-removing tool.

To achieve the foregoing objective, the joint-removing tool includes a control unit, a clamp unit and a connector unit. The control unit includes two levers pivotally connected to each other. Each of the levers includes a handle and a pivoting section. The handle and the pivoting section of the first lever are located between that of the second lever. The clamp unit includes a shell and two jaws. The shell includes an upper plate, a lower plate, two lateral plates and a rear plate. Each of the jaws includes a first section movably inserted in the shell, a second section in contact with the lateral plates, and a third section located out of the shell. A spring is compressed between the third sections of the jaws. The connector unit includes a wire extending throughout a sheath. The wire includes an end connected to the pivoting section of the first lever and another end connected to the first sections of the jaws. The sheath includes an end connected to the pivoting section of the second lever and another end connected to the rear plate. A spring is compressed between the first sections of the jaws and the rear plate.

Preferably, there is an angle $\alpha$ between the second and third sections of each of the jaws, with $90° < \alpha < 180°$.

Preferably, the angle $\alpha$ between the second and third sections of each of the jaws, with $100° \leq \alpha \leq 150°$.

Preferably, there is an angle $\beta$ between the second section of each of jaws and a corresponding one of the lateral plate, with $90° < \beta < 180°$.

Preferably, the angle $\beta$ between the second section of each of jaws and a corresponding one of the lateral plate, with $100° \leq \beta \leq 150°$.

Preferably, each of the jaws comprises a contact portion formed on the third section.

Preferably, each of the jaws comprises a boss fitted in a corresponding end of the spring of the clamp unit.

Preferably, the control unit further comprises a rivet for pivotally connecting the first lever to the second lever.

Preferably, the control unit further comprises a spring compressed between the handles of the first and second levers, thereby tending to pivot the pivoting sections of the first and second levers toward each other.

Preferably, the clamp unit further comprises a rivet pivotally connected to the first sections of the jaws and movably inserted in the shell, the second end of the wire is connected to the rivet, and the spring of the connector unit is compressed between the rivet and the rear plate.

Preferably, each of the upper and lower plates comprises a slot for movably receiving a section of a corresponding section of the rivet.

Preferably, the rivet comprises two enlarged ends located against the upper and lower plates, wherein the enlarged ends are made with a diameter larger than width of the slots.

Other objectives, advantages and features of the present invention will be apparent from the following description referring to the attached drawings.

BRIEF DESCRIPTION OF DRAWINGS

The present invention will be described via detailed illustration of two embodiments versus the prior art referring to the drawings wherein.

DETAILED DESCRIPTION OF EMBODIMENTS

Figure 1:
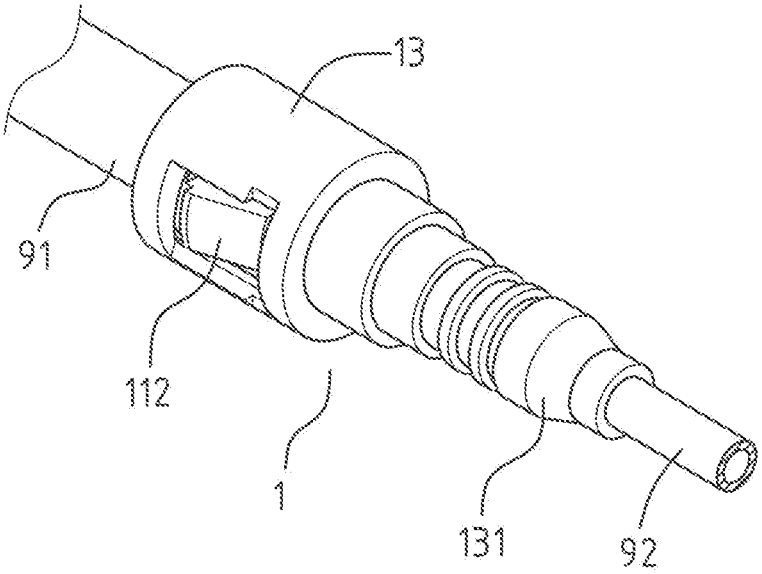
FIG. 1 PRIOR ART
FIG. 1 is a perspective view of a conventional joint interconnecting two tubes.
Figure 2:
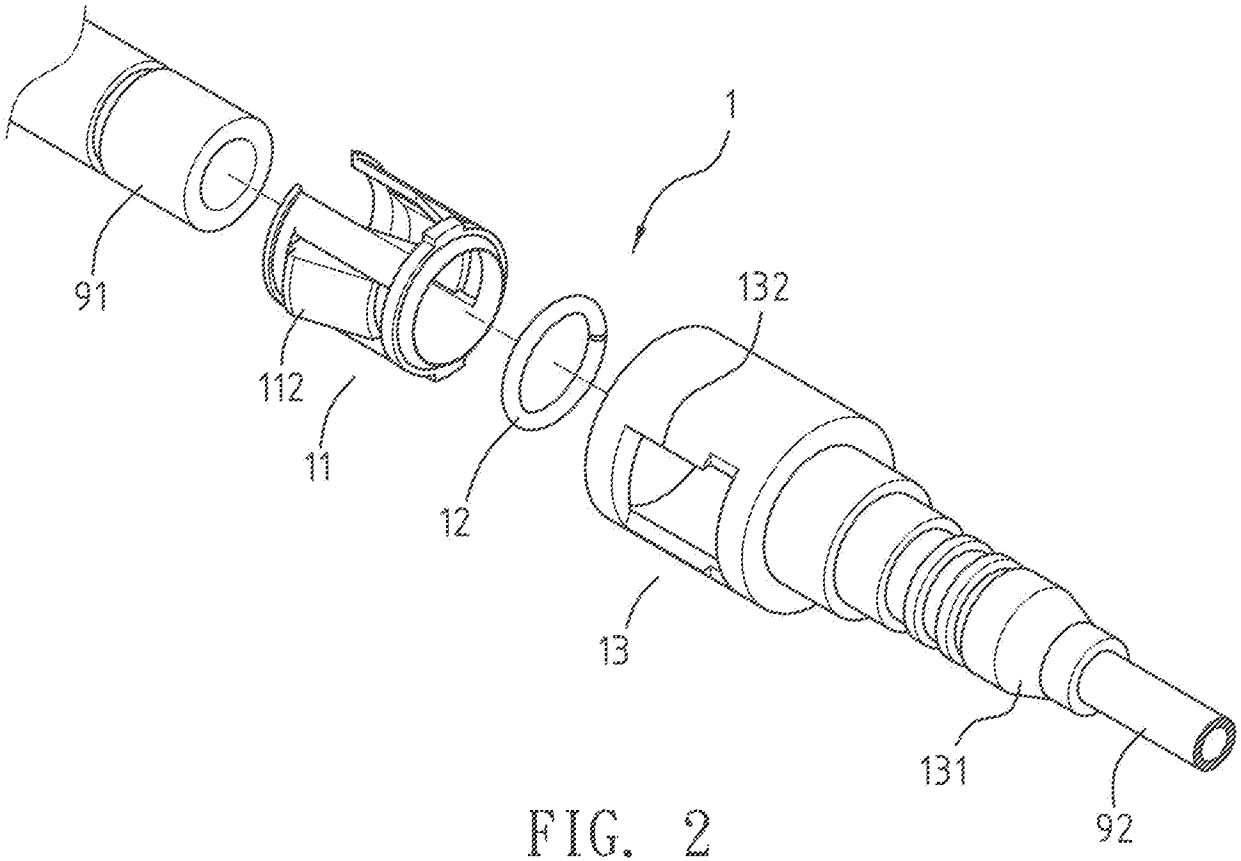
FIG. 2 PRIOR ART
FIG. 2 is an exploded view of the conventional joint shown in FIG. 1.
Figure 3:
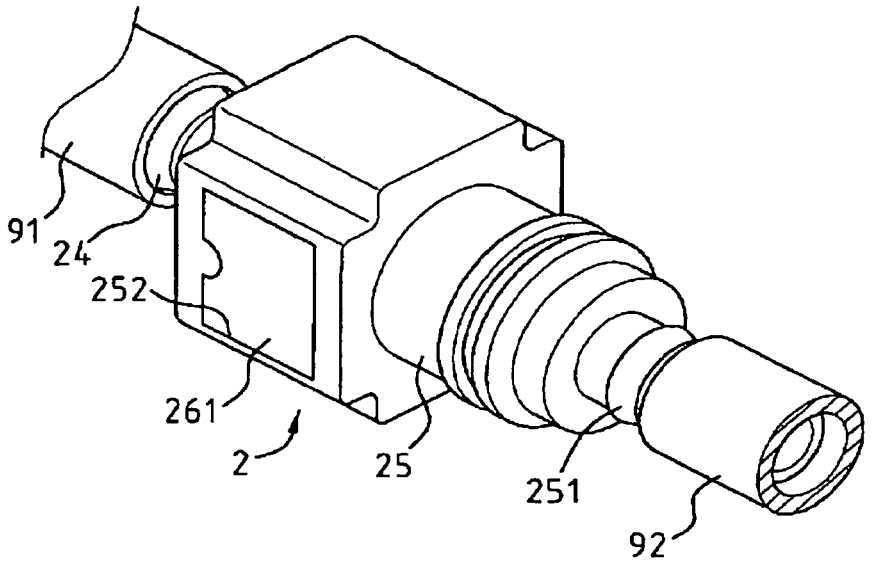
FIG. 3 PRIOR ART
FIG. 3 is a perspective view of another conventional joint interconnecting two tubes.
Figure 4:
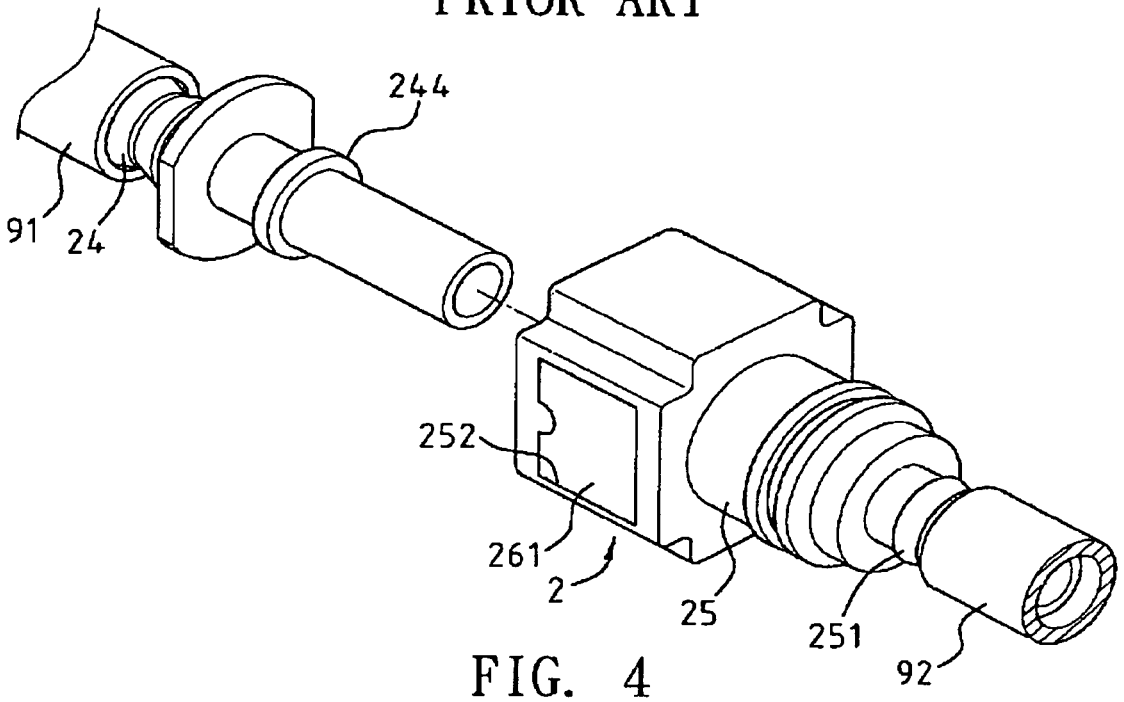
FIG. 4 PRIOR ART
FIG. 4 is an exploded view of the conventional joint shown in FIG. 3.
Figure 5:
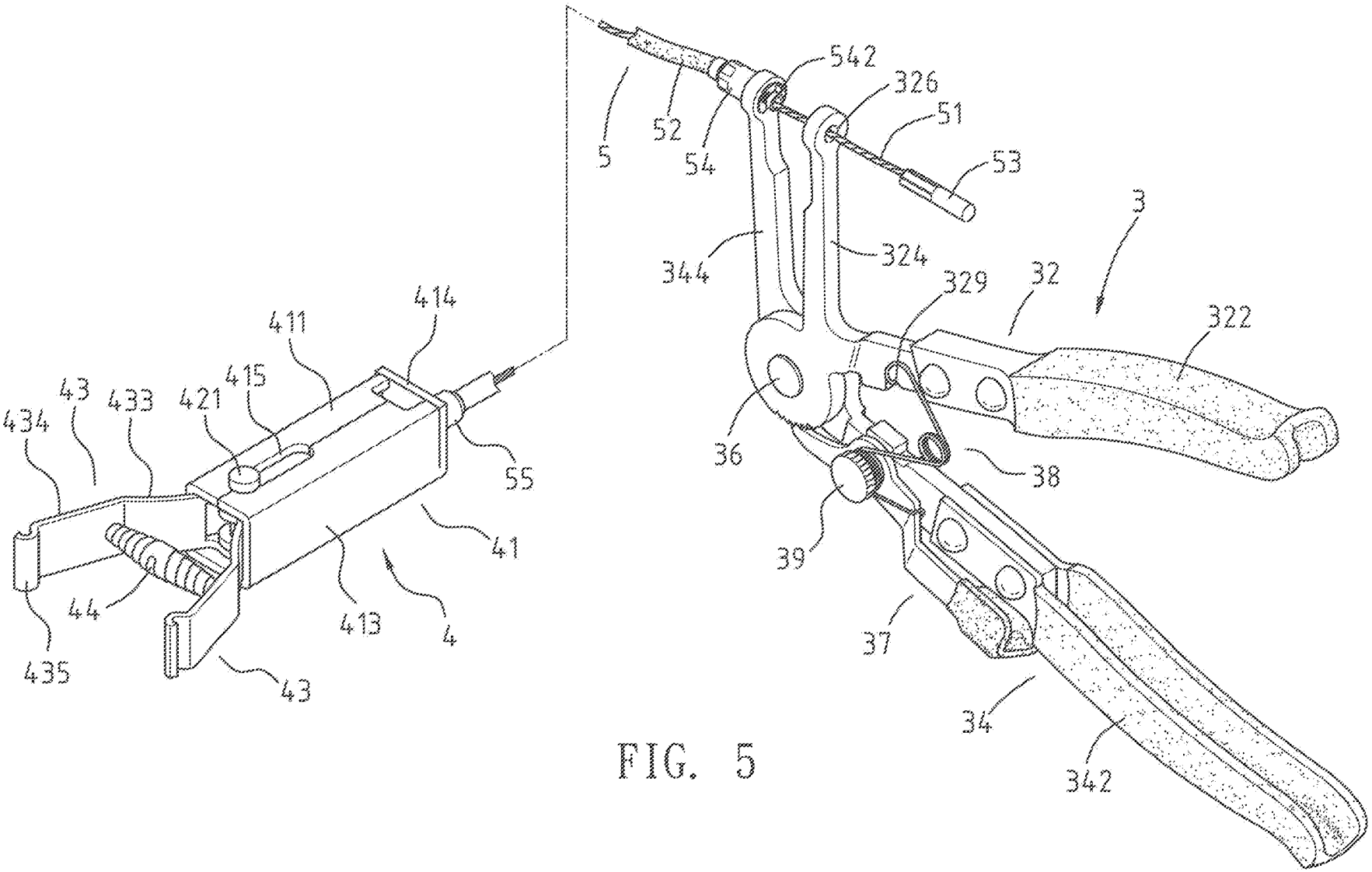
FIG. 5 is a perspective view of a joint-removing tool according to the first embodiment of the present invention.

Referring to FIG. 5, a joint-removing tool includes a control unit 3, a clamp unit 4 and a connector unit 5 according to a first embodiment of the present invention. The connector unit 5 includes an end connected to the control unit 3 and another end connected to the clamp unit 4. The control unit 3 is operable to control the clamp unit 4 via the connector unit 5.

Figure 6:
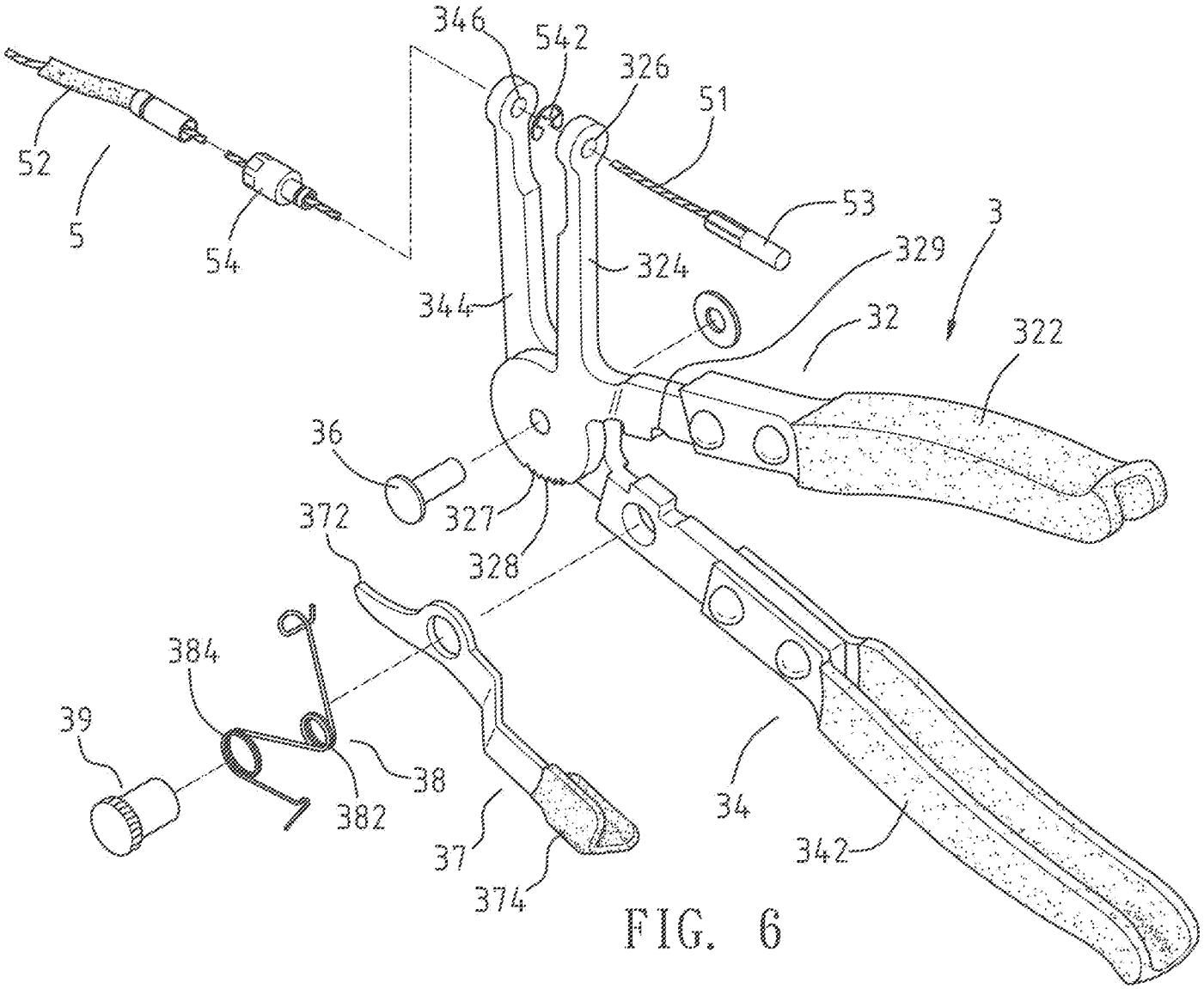
FIG. 6 is an exploded view of a control unit of the joint-removing tool shown in FIG. 5.
Figure 7:
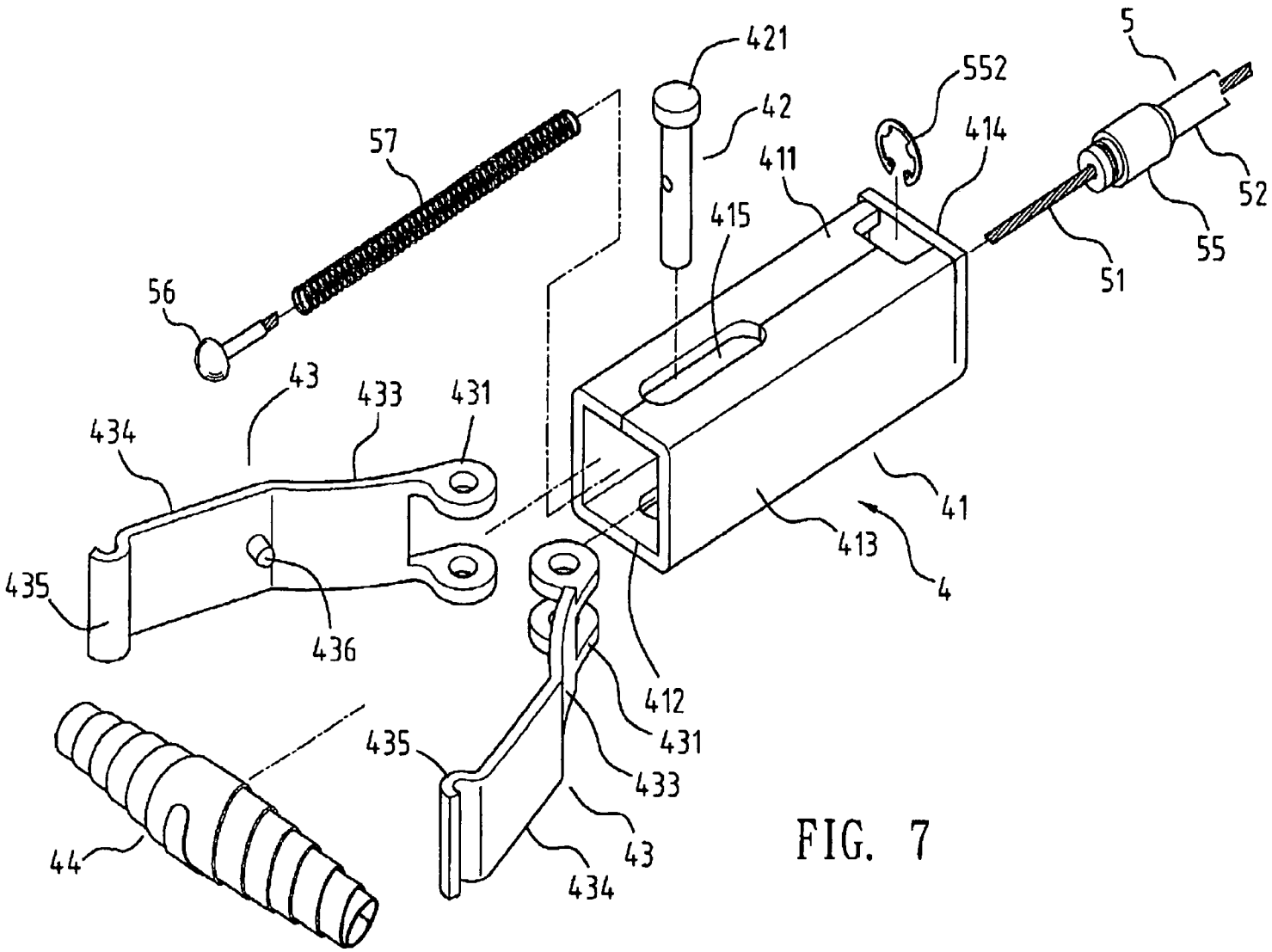
FIG. 7 is an exploded view of an actuating unit of the joint-removing tool shown in FIG. 5.
Figure 8:
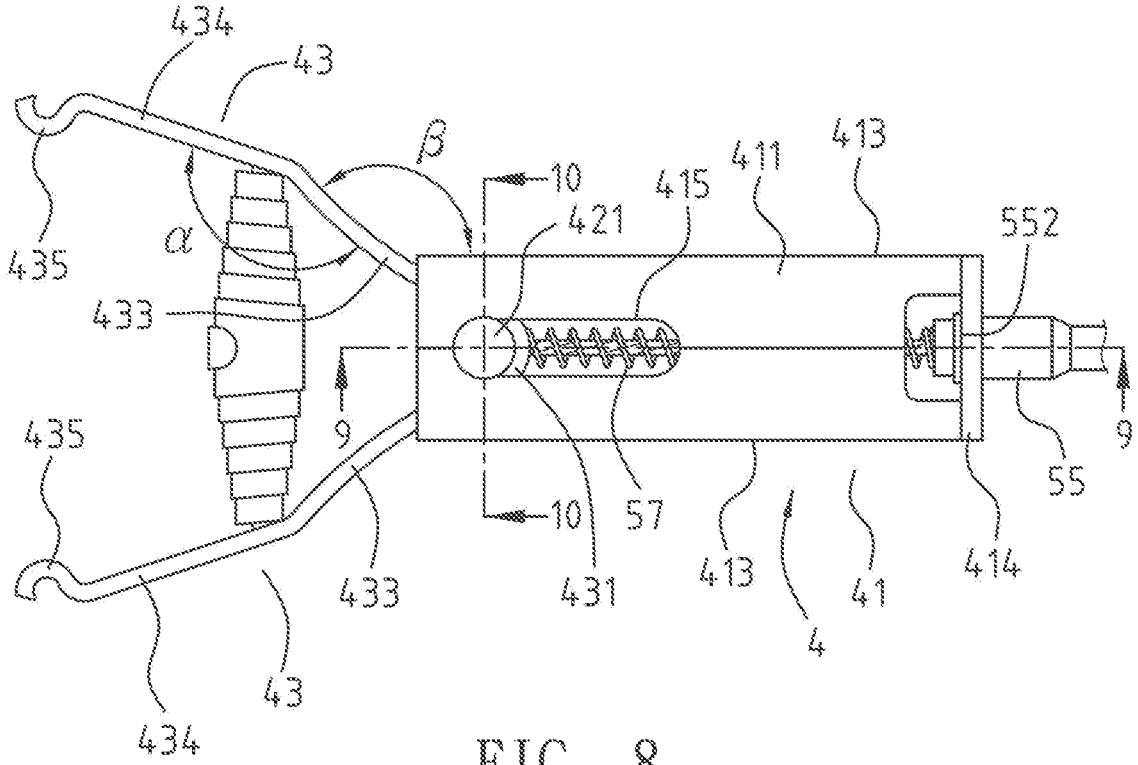
FIG. 8 is a top view of the actuating unit shown in FIG. 7.
Figure 9:
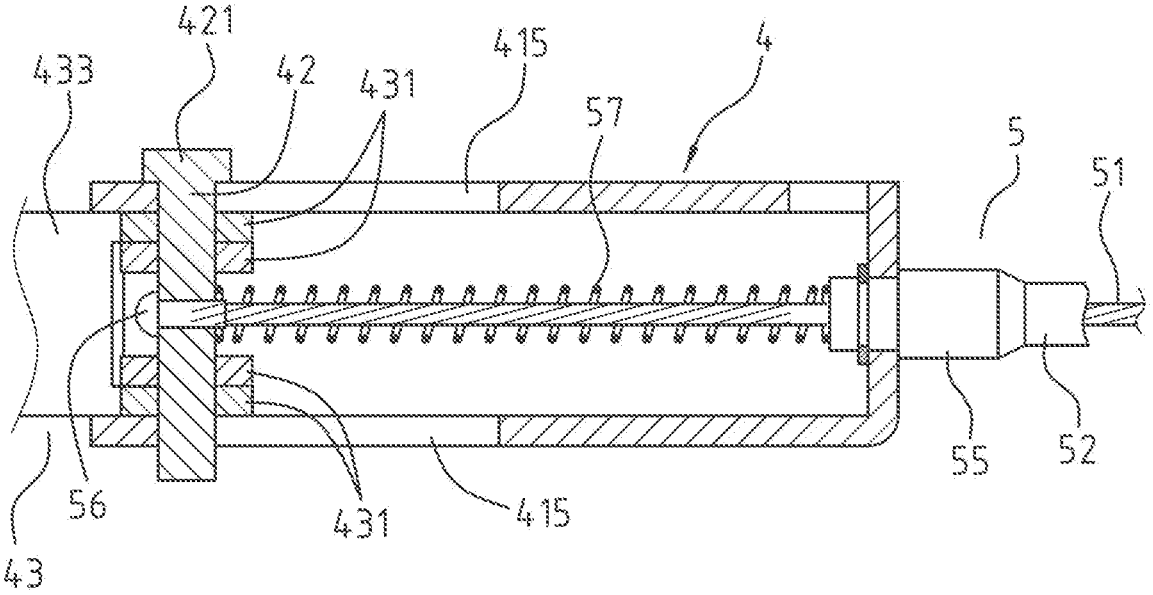
FIG. 9 is a cross-sectional view of the actuating unit taken along a line 9-9 shown in FIG. 8.
Figure 10:
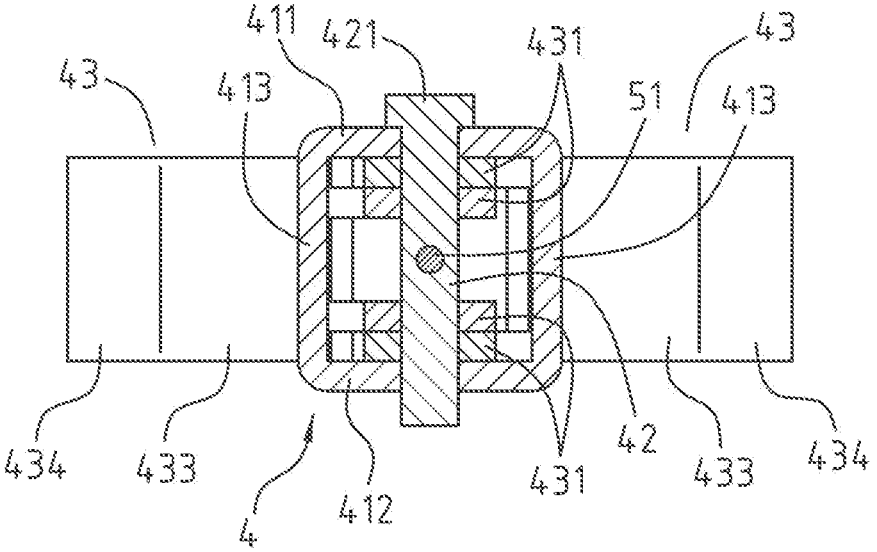
FIG. 10 is a cross-sectional view of the actuating unit taken along a line 10-10 shown in FIG. 8.

Referring to FIGS. 5 and 6, the control unit 3 includes two levers 32 and 34 and a rivet 36. The lever 32 includes a handle 322 formed at an end and a pivoting section 324 formed at another end. The pivoting section 324 includes an aperture 326 made near a free end. The lever 34 includes a handle 342 formed at an end and a pivoting section 344 formed at another end. The pivoting section 344 includes an aperture 346 made near a free end.

A middle section of the lever 32 is pivotally connected to a middle section of the lever 34 by the rivet 36 so that the lever 32 is rotatable relative to the lever 34 about the rivet 36. The handle 322 is located near the handle 342, and the pivoting section 324 is located near the pivoting section 344. There is an angle of less than 90 degrees between the handle 322 and the pivoting section 324. There is an angle of more than 90 degrees between the handle 342 and the pivoting section 344. Hence, the handle 322 and the pivoting section 324 are located between the handle 342 and the pivoting section 344. Moreover, the free end of the pivoting section 324 is moved from the free end of the pivoting section 344 when a free end of the handle 322 is pivoted toward a free end of the handle 342.

The control unit 3 further includes a spring 38 compressed between the lever 32 and the lever 34. The spring 38 tends to pivot the lever 32 from the lever 34.

The connector unit 5 includes a wire 51 and a sheath 52. The wire 51 is substantially inserted in the sheath 52 except for two ends. The first end of the wire 51 is connected to the control unit 3. The second end of the wire 51 is connected to the clamp unit 4. The first end of the wire 51 extends throughout the aperture 346 and the aperture 326 and is connected to a first end piece 53. The first end piece 53 is located against the pivoting section 324. Thus, the wire 51 is connected to the pivoting section 324.

The sheath 52 includes a first end connected to the control unit 3 and a second end connected to the clamp unit 4. The first end of the sheath 52 is inserted in a first collar 54. The first collar 54 includes a reduced section extending throughout the aperture 346. A first C-clip 542 is inserted in an annular groove made in the reduced section of the first collar 54. Thus, the sheath 52 is connected to the pivoting section 344. The sheath 52 is rotatable relative to the pivoting section 344.

About the rivet 36, the handle 322 and the handle 342 are pivoted toward each other so that the pivoting section 344 and the pivoting section 324 are pivoted from each other. The control unit 3 moves the wire 51 relative to the sheath 52. Thus, the control unit 3 controls the clamp unit 4 via the connector unit 5.

Referring to FIGS. 5 and 7 to 10, the clamp unit 4 includes a shell 41, a rivet 42, two jaws 43 and a spring 44. The shell 41 includes an upper plate 411, a lower plate 412, two lateral plates 413 and a rear plate 414. The upper plate 411 is located opposite to the lower plate 412. The upper plate 411 is formed between the lateral plates 413. The lower plate 412 is formed between the lateral plates 413. The rear plate 414 extends from a rear end of each of the lower plate 412 and is bent and placed against a rear end of the upper plate 411 and a rear end of each of the lateral plates 413. Each of the upper and lower plates 411 and 412 includes a slot 415 extending along a length. The slots 415 are aligned with each other.

The rivet 42 is movably connected to the shell 41. The rivet 42 extends throughout the slot 415. Thus, the rivet 42 is movable between closed ends of the slots 415. The rivet 42 includes an enlarged end 421 located against the upper plate 411. Another end (not numbered) of the rivet 42 is punched and enlarged after it is moved throughout the slot 415 of the lower plate 412. The enlarged ends of the rivet 42 are made with a diameter larger than the width of the slots 415. The enlarged end 421 is located against the upper plate 411. The other enlarged end is located against the lower plate 412.

The second end of the sheath 52 is inserted in a second collar 55. The second collar 55 includes a reduced section extending throughout an aperture (not numbered) made in the rear plate 414. A C-clip 552 is inserted in an annular groove (not numbered) made in the reduced section of the second collar 55 to connect the second collar 55 to the shell 41. The second end of the wire 51 is inserted in the shell 41. The second end of the wire 51 extends throughout the rivet 42. The second end of the wire 51 is connected to a second end piece 56. The second end piece 56 is located against a front face of the rivet 42. Thus, the wire 51 is connected to the rivet 42. A helical spring 57 is located on and around the wire 51. The helical spring 57 is compressed between the rivet 42 and the rear plate 414 so that an end thereof is located against the rivet 42 and another end thereof is located against the rear plate 414.

The control unit 3 is operable to move the second end of the wire 51 toward the rear end of the clamp unit 4. The wire 51 moves the rivet 42 toward the rear end of the shell 41. The rivet 42 further compresses the helical spring 57. Thus, the helical spring 57 is loaded and tends to move the rivet 42 toward a front end of the clamp unit 4.

Each of the jaws 43 is made by pressing a metal strip. Each of the jaws 43 includes a first section 431, a second section 433 extending from the first section 431, and a third section 434 extending from the second section 433. The first section 431 includes two co-axial lugs (not numbered). There is an angle $\alpha$ between the second section 433 and the third section 434, with $90° < \alpha < 180°$ and, more preferably, $100° \leq \alpha \leq 150°$.

The first section 431 of each of the jaws 43 is inserted in the shell 41. The first section 431 of each of the jaws 43 is located near a corresponding one of the lateral plates 413. The rivet 42 is inserted in the lugs of the first sections 431 of the jaws 43 so that the jaws 43 are rotatable about the rivet 42. The second section 433 of each of the jaws 43 includes a portion located in the shell 41 and another portion located out of the shell 41. The second section 433 of each of the jaws 43 is in contact with the corresponding lateral plate 413. There is an angle β between the second section 433 of each of the jaws 43 and the corresponding lateral plate 413, with $90° < \beta < 180°$ and, more preferably, $100° \leq \beta \leq 150°$. As the rivet 42 is moved toward the rear end of the shell 41, the second sections 433 of the jaws 43 are pivoted toward each other about the rivet 42 since they are pressed against the lateral plates 413. Hence, the third sections 434 of the jaws 43 are moved toward each other.

Preferably, the third section 434 of each of the jaws 43 includes a contact portion 435. The contact portions 435 of the second sections 434 of the jaws 43 extend toward each. The contact portions 435 are used to ensure effective contact of the jaws 43 with the locking strips 112 or 261 of the joint 1 or 2 as described in RELATED PRIOR ART.

The spring 44 includes two ends respectively in contact with the jaws 43. The spring 44 is compressed between the jaws 43. Thus, the spring 44 tends to push the jaws 43 from each other, i.e. toward the lateral plates 413. Each of the jaws 43 further includes a boss 436 inserted in a corresponding one of the ends of the spring 44 so that the spring 44 is kept between the jaws 43.

The control unit 3 is connected to the clamp unit 4 via the connector unit 5. The clamp unit 4 can be located deeply in an engine compartment while the control unit 3 is located out of the engine compartment. The control unit 3 is easily maneuverable to control the clamp unit 4, via the connector unit 5, to clamp the locking strips of the joint. Thus, the joint can be removed from the tubes.

The joint-removing tool is maneuverable to remove the joint 1 or 2, which includes the locking elements 112 or 261. The clamp unit 4 is moved to the vicinity of the joint 1 or 2, and the third sections 434 of the jaws 43 are aligned with the locking strips 112 or 261. The handles 322 and 342 of the first and second levers 32 and 34 are pivoted toward each other about the rivet 36. Thus, the first and second levers 32 and 34 are pivoted, and the free ends of the pivoting sections 324 and 344 of the first and second levers 32 and 34 are moved from each other. The wire 51 is moved relative to the sheath 52. The wire 51 moves the rivet 42 toward the rear end of the shell 41. The rivet 42 moves the jaws 43 toward the rear end of the shell 41. In the movement of the jaws 43 toward the rear end of the shell 41, the third sections 434 of the jaws 43 are pivoted toward each other about the rivet 42 because the second sections 433 of the jaws 43 are located against the lateral plates 413. The third sections 434 of the jaws 43 move the locking strips 112 or 261 toward each other. Finally, the joint 1 or 2 is disassembled, thereby disconnecting the first tube 91 from the second tube 92.

To release the locking strips 112 or 261 from the jaws 43, the lever 32 and the lever 34 are released. The spring 38 pivots the handle 322 of the lever 32 from the handle 342 of the lever 34. Thus, the pivoting section 324 is pivoted toward the pivoting section 344. The helical spring 57 moves the rivet 42 toward the front end of the shell 41. The spring 44 pivots the third sections 434 of the jaws 43 from each other, i.e., from the locking strips 112 or 261 of the joint 1 or 2.

Referring to FIGS. 5 and 6, the control unit 3 further includes a positioning element 37. The lever 32 includes alternatively arranged cutouts 327 and teeth 328 at an edge of the middle portion of the handle 32. The positioning element 37 is pivotally connected to the handle 342 by a rivet 39. Thus, the positioning element 37 is rotatable about the rivet 39. The positioning element 37 includes a tip 372 inserted in a selected one of the cutouts 327, i.e., engaged with a selected one of the teeth 328 to prevent the lever 32 from rotation relative to the lever 34. The positioning element 37 includes, at another end, a handle 374. The handle 374 is operable to pivot the positioning element 37 about the rivet 39, thereby disengaging the tip 327 from any of the teeth 328 or engaging the tip 327 with a selected one of the teeth 328.

The spring 38 is a torque spring formed with two ends, a primary coil 382 and a secondary coil 384. The first end of the spring 38 is inserted in a recess 329 made in the handle 322. The second end of the spring 38 hooks the handle 374. The rivet 39 is inserted in the secondary coil 384, thereby keeping the spring 38 in position. The spring 38 tends to pivot the handle 374 away from the handle 322, thereby keeping the tip 327 in a selected one of the recesses 327.

When the handle 322 is pivoted toward the handle 342, the lever 32 is pivoted relative to the lever 34 about the rivet 36. The lever 32 is pivoted relative to the positioning element 37. The spring 38 biases the positioning element 37 to retain the tip 372 in contact with the lever 32. Thus, the tip 372 rattles on and moves past the teeth 328. As the spring 38 keeps the tip 372 engaged with one of the teeth 328, the position of the jaws 43 relative to each other is retained even when the handle 322 and the handle 342 are released from any external force in the operation of the control unit 3. Hence, the locking strips 112 or 261 are always pivoted toward each other by the jaws 43.

After the joint is removed, the handle 374 is pivoted, and hence the tip 372 is disengaged from any of the teeth 328. Now, the spring 38 is allowed to pivot the handle 322 from the handle 342.

Figure 11:
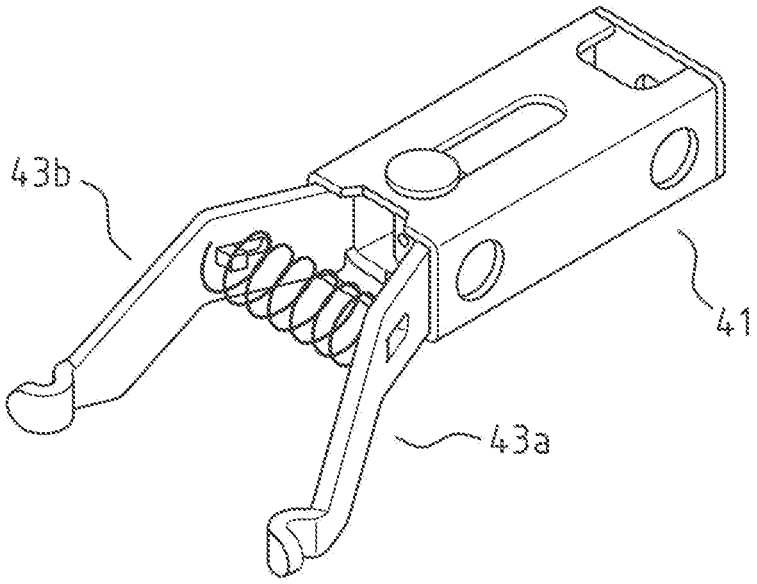
FIG. 11 is a perspective view of an actuating unit of a joint-removing tool according to the second embodiment of the present invention.
Figure 12:
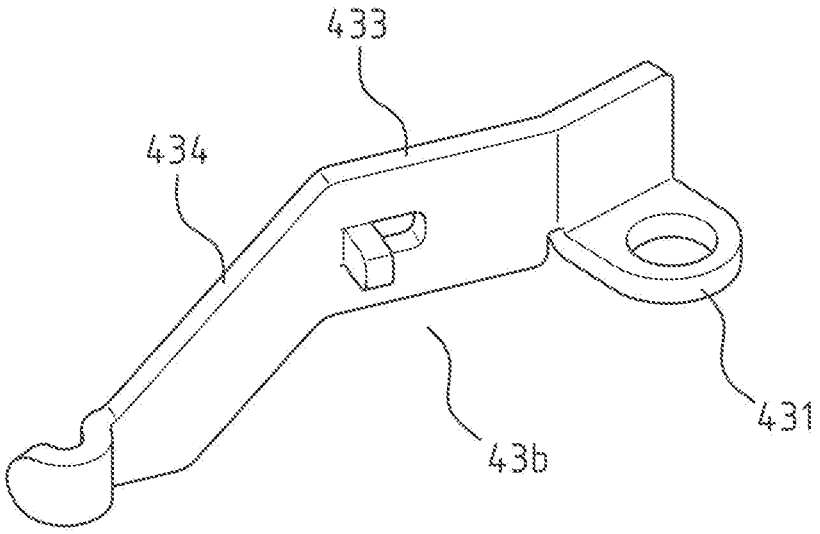
FIG. 12 is a perspective view of a handle of the actuating unit shown in FIG. 11.
Figure 13:
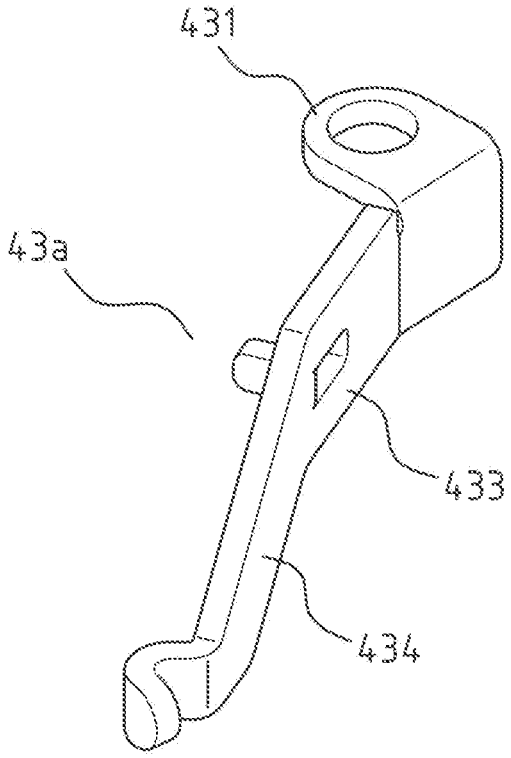
FIG. 13 is a perspective view of another handle of the actuating unit shown in FIG. 11.

Referring to FIGS. 11 to 13, there is a clamp unit according to a second embodiment of the present invention. The second embodiment is like the first embodiment except for several things. Firstly, two jaws 43*a* and 43*b* are used instead of the jaws 43. The jaws 43*a* and 43*b* are like the jaws 43 except that each of the jaws 43*a* and 43*b* includes only one lug formed on the first section 431 thereof. Secondly, a helical spring is used instead of the spring 44.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. A joint-removing tool comprising:

a control unit (3) comprising:

a first lever (32) comprising a handle (322) and a pivoting section (324); and a second lever (34) pivotally connected to the first lever (32) and formed with a handle (342) and a pivoting section (344), wherein the handle (322) and the pivoting section (324) of the first lever (32) are located between the handle (342) and the pivoting section (344) of the second lever (34);

a clamp unit (4) comprising:

a shell (41) comprising an upper plate (411), a lower plate (412), two lateral plates (413) and a rear plate (414);

two jaws (43) each comprising a first section (431) movably inserted in the shell (41), a second section (433) in contact with the lateral plates (413), and a third section (434) located out of the shell (41); and a spring (44) compressed between the third sections (434) of the jaws (43);

a connector unit (5) comprising:

a wire (51) comprising a first end connected to the pivoting section (324) of the first lever (32) and a second end connected to the first sections (431) of the jaws (43); and a sheath (52) comprising an end connected to the pivoting section (344) of the second lever (34) and another end connected to the rear plate (414); and a spring (57) compressed between the first sections (431) of the jaws (43) and the rear plate (414); and wherein the clamp unit (4) further comprises a rivet (42) pivotally connected to the first sections (431) of the jaws (43) and movably inserted in the shell (41), the second end of the wire (51) is connected to the rivet (42), and the spring (57) of the connector unit (5) is compressed between the rivet (42) and the rear plate (414).

2. The joint-removing tool according to claim 1, wherein there is an angle $\alpha$ between the second and third sections (433, 434) of each of the jaws (43), with $90° < \alpha < 180°$.

3. The joint-removing tool according to claim 2, wherein $100° \leq \alpha \leq 150°$.

4. The joint-removing tool according to claim 1, wherein there is an angle $\beta$ between the second section (433) of each of jaws (43) and a corresponding one of the lateral plate (413), with $90° \leq \beta < 180°$.

5. The joint-removing tool according to claim 4, wherein $100° \leq \beta \leq 150°$.

6. The joint-removing tool according to claim 1, wherein each of the jaws (43) comprises a contact portion (435) formed on the third section (434).

7. The joint-removing tool according to claim 1, wherein each of the jaws (43) comprises a boss (436) fitted in a corresponding end of the spring (44) of the clamp unit (4).

8. The joint-removing tool according to claim 1, wherein the control unit (3) further comprises a rivet (36) for pivotally connecting the first lever (32) to the second lever (34).

9. The joint-removing tool according to claim 1, wherein the control unit further comprises a spring (38) compressed between the handles (322, 342) of the first and second levers (32, 34), thereby tending to pivot the pivoting sections (324, 344) of the first and second levers (32, 34) toward each other.

10. The joint-removing tool according to claim 1, wherein each of the upper and lower plates (411, 412) comprises a slot (415) for movably receiving a section of a corresponding section of the rivet (42).

11. The joint-removing tool according to claim 1, wherein the rivet (42) comprises two enlarged ends (421) located against the upper and lower plates (411, 412), wherein the enlarged ends (421) are made with a diameter larger than width of the slots (415).

* * * * *